US006101347A

United States Patent [19]

Rokutanda et al.

[11] Patent Number: 6,101,347

[45] Date of Patent: Aug. 8, 2000

[54] PAPER CARRYING DEVICE IN ELECTROSTATIC RECORDING APPARATUS

[75] Inventors: Takashi Rokutanda; Takao Umeda; Yukio Otome; Nobuyuki Mori, all of Ibaraki, Japan

[73] Assignee: Hitachi Koki Co., Ltd., Tokyo, Japan

[21] Appl. No.: 09/324,724

[22] Filed: Jun. 3, 1999

[30] Foreign Application Priority Data

Jun. 4, 1998 [JP] Japan ..... 10-155645

[51] Int. Cl.[7] ..... G03G 15/00; G03G 21/00

[52] U.S. Cl. ..... 399/99; 399/306; 399/400

[58] Field of Search ..... 399/71, 98, 99, 399/306, 343, 361, 397, 400; 271/225, 198

[56] References Cited

U.S. PATENT DOCUMENTS 3,993,022 11/1976 Zimmer ..... 399/99
4,427,285 1/1984 Stange ..... 399/306
5,453,822 9/1995 Anzai et al. ..... 399/306 X
5,565,081 10/1996 Krespan et al. ..... 205/460
5,729,788 3/1998 Hirohashi et al. ..... 399/66

FOREIGN PATENT DOCUMENTS 7-72776 3/1995 Japan .

*Primary Examiner*—Sophia S. Chen
*Attorney, Agent, or Firm*—Sughrue, Mion, Zinn, Macpeak & Seas, PLLC

[57] ABSTRACT

There are provided a paper separating mechanism for bringing paper into a state of non-contact with a paper carrying roll; a motor for independently driving the paper carrying roll; and a switch for changing-over the paper carrying roll driving mode between a following mode and an independent driving mode so that the driving mode is changed over to the following mode and independent driving mode at the time of printing and at the time of non-printing, respectively.

6 Claims, 7 Drawing Sheets

PAPER CARRYING DEVICE IN ELECTROSTATIC RECORDING APPARATUS

BACKGROUND OF THE INVENTION

1. Field of the Invention

The present invention relates to an electrostatic recording apparatus such as a copying machine, a printer, or the like, utilizing an electrophotographic system, and particularly relates to a paper carrying device provided between a transfer portion and fixing device in an electrostatic recording apparatus in which double-surface printing is performed in such a manner that unfixed toner images are formed on the opposite surfaces of paper and fixed by using the fixing device.

2. Description of the Related Art

An electrophotographic system is one of the best known development systems to be utilized in a copying machine or a printer. Particularly in a line printer which requires high-speed printing, ability of higher-speed printing is required with increase of the quantity of information to be processed, and further the picture is required to have high quality and high resolution. Moreover, recently, thinking about saving natural resources or energy is progressed for the purpose of protecting the environment of the earth and hence in the printer, needs for the function of double-surface printing are increased. Here, as a method of double-surface printing by utilizing the electrophotographic system, there is proposed such a method that, in a printer for cut paper, paper is turned over by means of a carrier system constituted by a switch-back mechanism after completion of front-surface printing to thereby make printing on the rear surface of the paper. This system, however, is unsuitable for high-speed printing because its paper carrying mechanism is complicated. Further, this system cannot perform printing on continuous paper. Generally, double-surface printing of continuous paper is performed by using two printers. First, paper having one surface already subjected to printing by means of a first printer is turned over by means of a paper turning-over mechanism, so that the other surface of the paper is then subjected to printing by means of a second printer. Although this method is suitable for high-speed printing because the printing speed is never reduced, the volume of the whole printing system is increased because of using two printers to thereby increase the cost of the system. Further, since the toner is separately fixed on the opposite surfaces of paper, two fixing devices using the largest power consumption are required and, as a result, the energy saving is obstructed.

Therefore, a mechanism for fixing toner on the opposite surfaces of paper at the same time has been proposed and investigated. In this proposed mechanism, unfixed toner images are formed on the opposite surfaces of paper by using two sets of photoconductive printing mechanism portions and the toner images are fixed at the same time on the opposite surfaces of the paper by using one fixing device. By this method, high-speed and double-surface printing can be performed with one fixing device.

FIG. 2 is a schematic view showing the configuration of the printer of the double-surface and simultaneous-fixing system. Here, description will be made as to the case of using a photoconductive printing apparatus of the reversal development utilizing a positively charged photoconductive drum of SeTe, $As_2Se_3$, Amorphous Si, positively charged OPC, or the like, and positively charged toner. Positive charges are applied from a corona charger 2*a* to a photoconductive drum 1*a*; a light pattern is given from an exposure portion 3*a* such as a laser optical system, LED, or the like, to form an electrostatic latent image; and toner development is performed by means of a developing device 5*a*. Negative charges are applied from corona transfer device 4*a* to a rear surface of paper 10 to transfer a toner image 6*a* on the photoconductive drum 1*a* to the paper 10. The thus configured photoconductive printing apparatus is defined as a first printing apparatus and a surface of paper to be subjected to printing by this first photoconductive printing apparatus is defined as a front surface. Similarly to this, a positively charged toner image 6*b* is then transferred to the rear surface of the paper 10 by means of a second photoconductive printing apparatus constituted by a photoconductive drum 1*b*. The second photoconductive printing apparatus includes similar features to the first photoconductive printing apparatus, such as a corona charger 2*b*, an exposure portion 3*b*, a corona transfer device 4*b*, and a developing device 5*b*. As a result, toner images 7*a* and 7*b* are formed on the opposite surfaces of the paper 10. The toner images 7*a* and 7*b* formed on the opposite surfaces of the paper 10 are fused and fixed firmly on the paper by means of fixing device 9 of the heat-roll system. In this case, the reference numeral 8 designates a paper carrying device provided in a paper carrying path between the photoconductive printing apparatuses and the fixing devices so as to change the carrying direction of the paper. As shown in FIG. 3, the paper carrying device 8 is mainly constituted by a paper carrying roll 11 following the paper 10; a cleaning brush 15 for cleaning the paper carrying roll 11; and a charger 13 for applying negative charge to a rear surface of paper. The positively charged unfixed toner 7*b* is drawn to the paper by means of the charger 13 on one hand and a voltage in a range of from +10000V to +2000V is applied from a high-voltage power source to a core metal of the paper carrying roll 11 on the other hand so that the unfixed toner 7*b* is prevented from adhering on the surface of the paper carrying roll 11 to the utmost. Further, an electrostatic absorbing force is made to act between the paper 10 and the paper carrying roll 11 so that the paper carrying roll 11 can rotate while following the paper 10 (U.S. patent application Ser. No. 08/925,763 corresponding to JP-A-8-247597). The surface of the paper carrying roll 11 is formed of a conductive material having a volume resistance in a range of from $10^7$ Ω·cm to $10^{11}$ Ω·cm and toner is prevented from adhering onto the surface by a method of applying a voltage to the core metal. Therefore, it is not necessary to provide any external charger for charging the paper carrying roll, for example, as described in JP-A-7-072776. Adhering matters 14, particularly toner, collected by the cleaning brush 15 are knocked down by means of a knocking rod 16 and collected into a discharged-toner collecting box 17.

Here, in the case where a sudden change of the speed, for example, paper jamming occurred, it was found that, as shown in FIG. 3, the toner 7*b* transferred onto the rear surface of the paper 10 fell onto the paper carrying roll 11 to form a contaminant 7*c* on the surface of the paper carrying roll 11. If the contaminant 7*c* would adhere, as shown in FIG. 4, on the downstream side with respect to the cleaning brush 15 and before the contacting position of the paper 10 with the paper carrying roll 11 upon stoppage of printing, the contaminant 7*c* would move from the surface of the paper carrying roll 11 to the rear surface of the paper 10 after re-starting of printing to thereby lower the picture quality. The adhesion of the contaminant 7*c* is a phenomenon which can be recognized also in the case where printing has not been performed for a long time regardless of paper jamming. In this case, dust in the air or toner or paper powder floating in the apparatus causes the phenomenon. Consequently, it is necessary to provide means for removing dust, toner, or paper powder before starting of printing again. The background-art paper carrying roll 11 (JP-A-8-247597) could not remove the contaminant 7*c* adhering on the surface of the paper carrying roll 11 upon stoppage of the printing because the paper carrying roll 11 followed the paper. Therefore, when printing was started again, paper was wasted by at least a half-circumferential part thereof.

SUMMARY OF THE INVENTION

The present invention has been made to solve the above problem and therefore an object of the present invention is to clean contaminant adhering on a surface of a paper carrying roll following to paper even though no paper is carried in a process of performing high-speed double-surface simultaneous printing.

The foregoing object can be solved in such a manner that means for separating paper from a paper carrying roll upon stoppage of printing is provided, the paper carrying roll is provided with a motor for independently driving the paper carrying roll, and the mode for driving the paper carrying roll is changed over between following driving and independent driving correspondingly to the time of printing and at the time of printing stoppage, respectively.

DETAILED DESCRIPTION OF THE PREFERRED EMBODIMENTS

Now, a description will be given in more detail of preferred embodiments with reference to the accompanying drawings.

Figure 1:
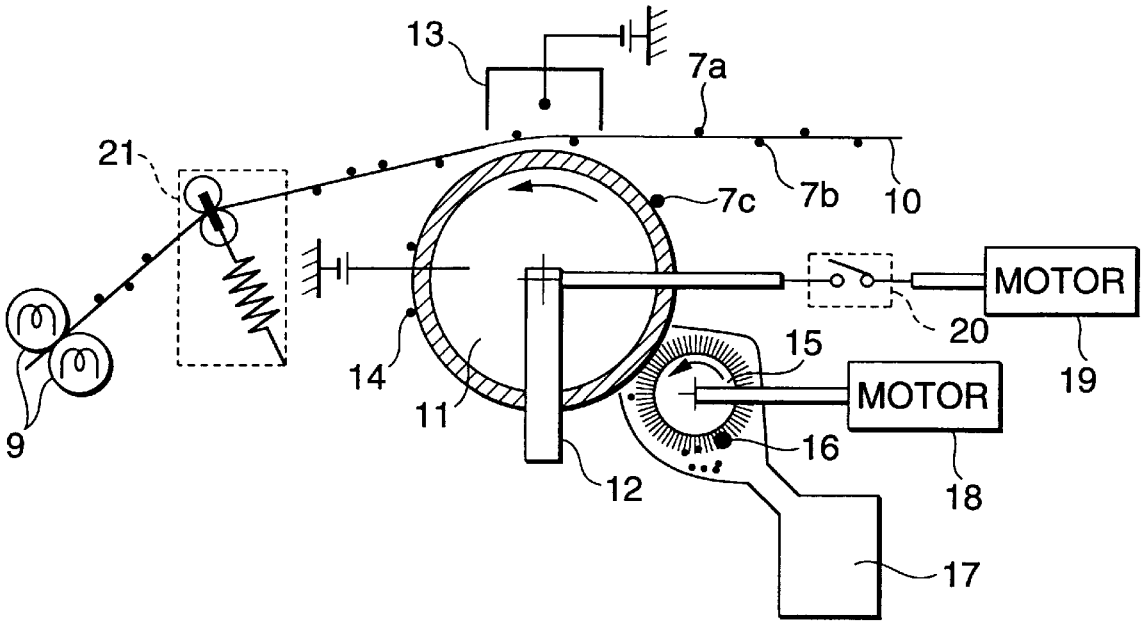
FIG. 1 is a schematic view showing an embodiment of the paper carrying device according to the present invention.
Figure 2:
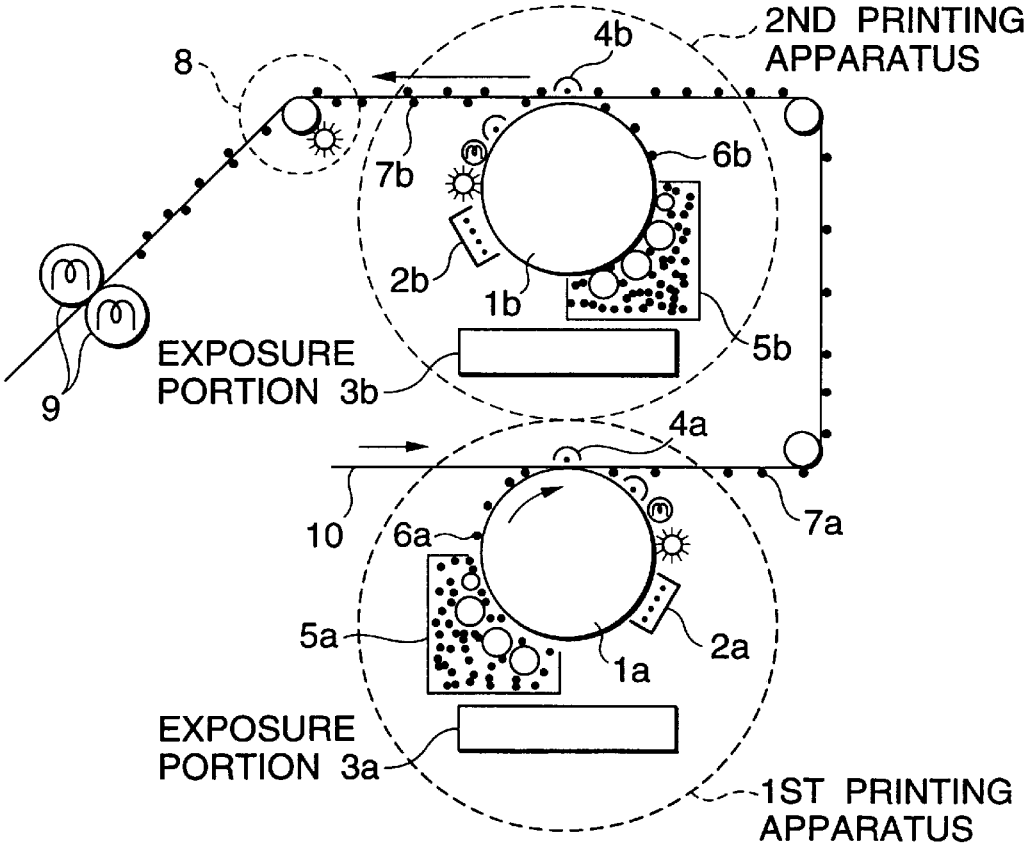
FIG. 2 is a schematic view showing a double-surface printing apparatus using an electrostatic recording system.
Figure 3:
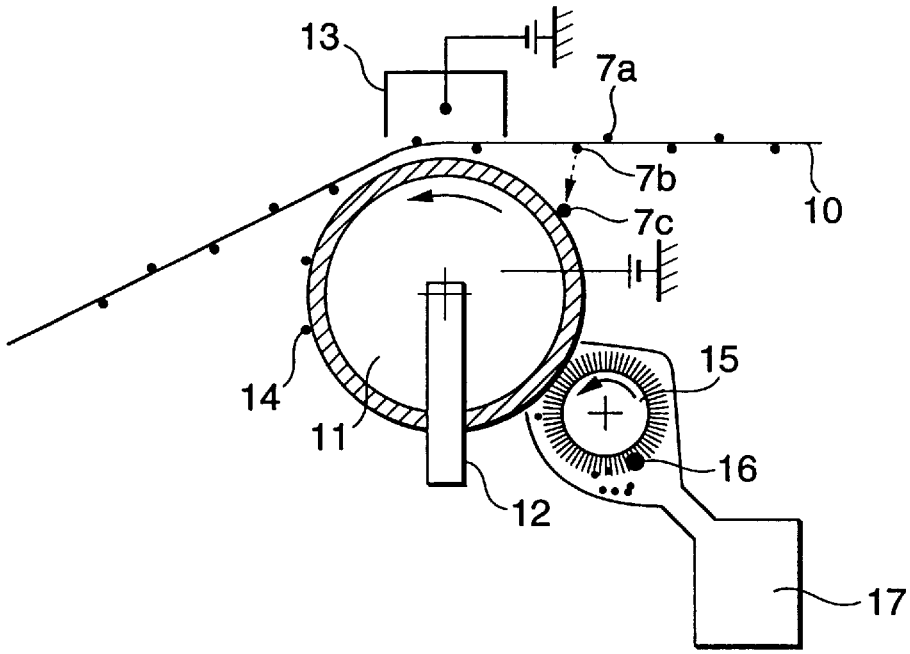
FIG.3 PRIOR ART
FIG. 3 is a schematic view showing the conventional paper carrying device.
Figure 4:
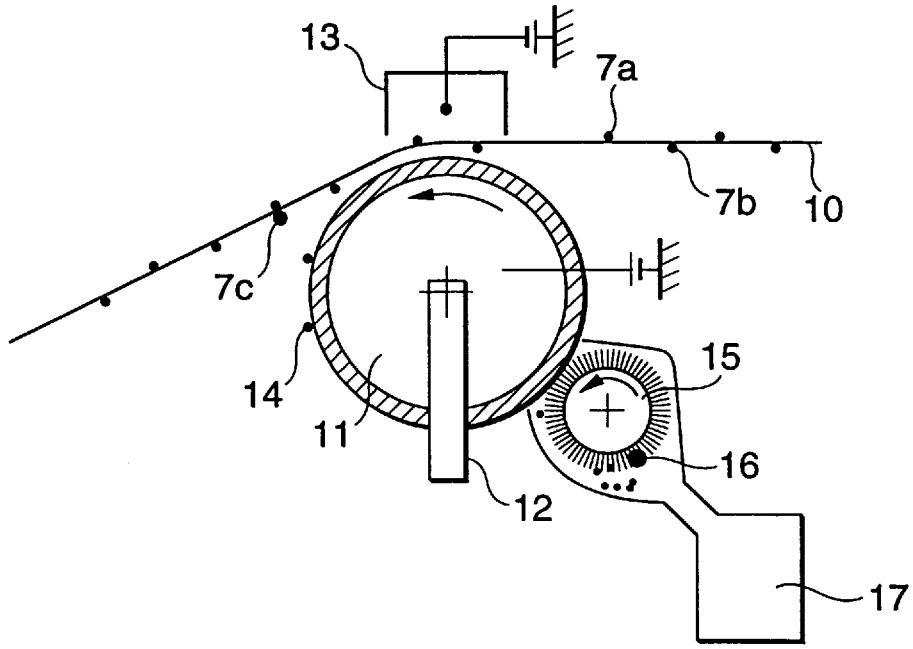
FIG.4 PRIOR ART
FIG. 4 is a schematic view showing the conventional paper carrying device.

FIG. 1 shows an embodiment of the present invention. As shown in FIG. 1, a paper carrying roll 11 is connected to a motor 19 for independently driving the paper carrying roll 11 and a change-over switch 20 for performing change-over between following driving and independent driving. A support member 12 rotatably supports an axis of the paper carrying roll. With such a configuration, the paper carrying roll 11 can be independently driven. The change-over between following driving and independent driving is performed such that the following driving mode is selected at the time of printing so as not to disturb images on the contacting portion between the roll 11 and the paper 10 and the independent driving mode is selected at the time of non-printing.

Figure 5:
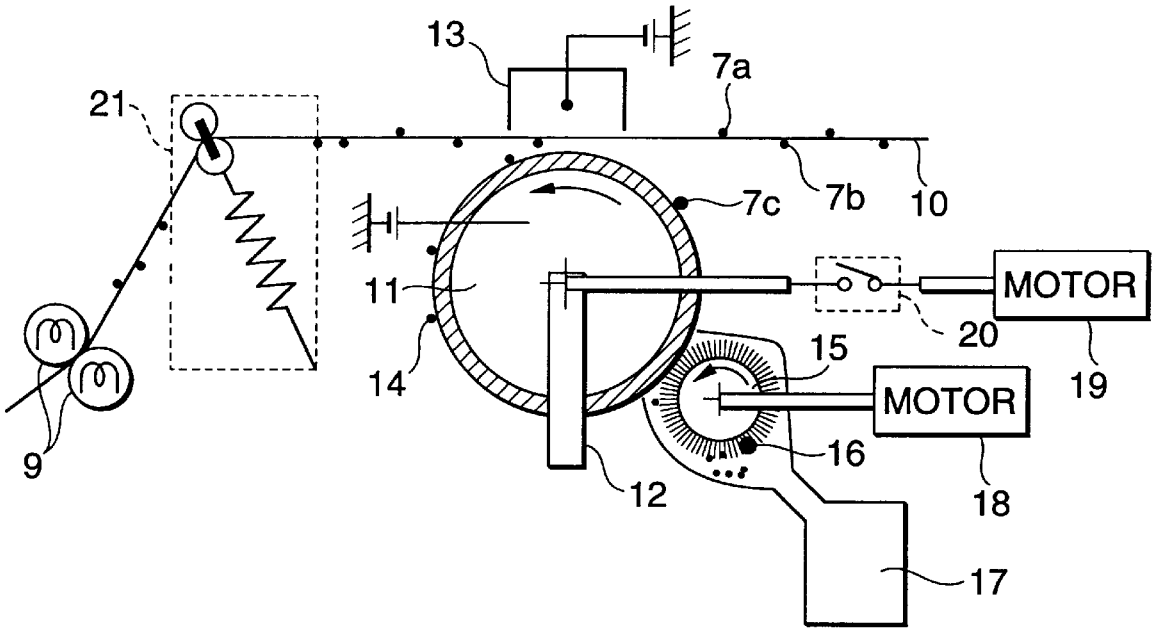
FIG. 5 is a schematic view showing the paper carrying device in a state where paper is separated from the paper carrying device according to the embodiment of the present invention.
Figure 6:
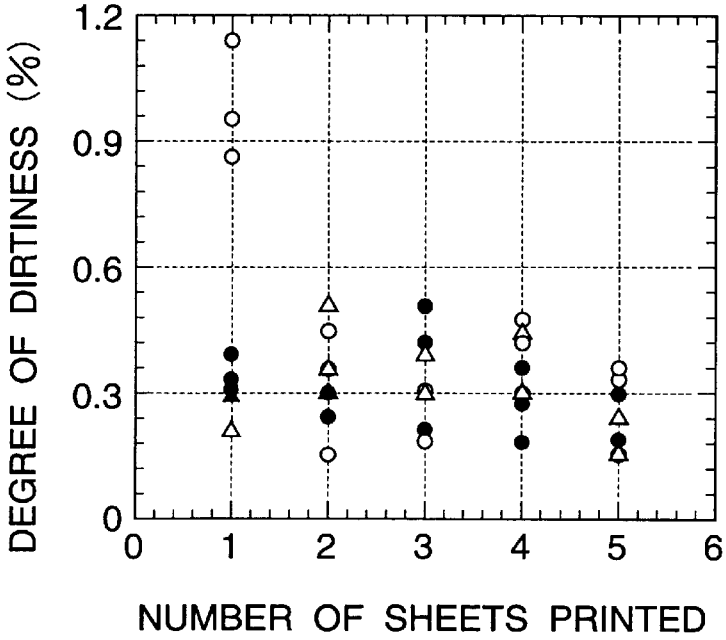
FIG. 6 is a graph showing the relation between the number of printed paper and the degree of dirt thereof in the paper carrying device according to the present invention.

If the paper carrying roll 11 is made to rotate in the state where the paper 10 and the paper carrying roll 11 contact with each other as they are, the images on the contact portion may be disturbed. Accordingly, it is necessary to separate the paper 10 from the paper carrying roll 11. In this embodiment, a paper separating device 21 is provided at the downstream side of the paper carrying roll 11 with respect to the paper carrying direction. A rod for supporting the paper separating device 21 is constituted by a spring. Normally, the rod acts as a mechanism (a buffer mechanism) for applying tension to the paper at the time of printing for the purpose of preventing the paper from being broken. When the paper 10 is to be separated from the paper carrying roll 11, the paper is located as shown in FIG. 5. That is, at the time of stopping printing, for example, in case of jamming or the like, the driving mode for the paper carrying roll is changed over from the following driving mode to the independent driving mode by means of the paper separating device 21, the motor 19, and the change-over switch 20, and the paper carrying roll 11 is made to rotate in the separated state from the paper 10 so as to be cleaned by means of a cleaning brush 15. As a result, a high picture quality can be always obtained. FIG. 6 is a result showing the effects of the present invention. In the drawing, the ordinate shows the degree of dirtiness $\Delta Y$ of paper. Assuming that the degree of whiteness of reference blank paper (white paper before printing) is Y0 and the degree of whiteness of blank paper after printed is Y1, the degree of dirtiness $\Delta Y$ of paper is obtained from the expression of $Y0-Y1$ (>0). Increase in the value of $\Delta Y$ designates increase of the degree of dirtiness of printed blank paper. HunterLab D25 with DP-9000 produced by U.S. Hunter Inc. was used for measurement of the value of Y in this embodiment. In the drawing, ● designates each of the values $\Delta Y$ of five sheets of printed blank paper from a given page. That is, the mark designates a so-called fog in the picture quality. Further, ○ designates the value of $\Delta Y$ when the electrostatic recording apparatus is urgently stopped and then printing is started again without cleaning the paper carrying roll 11. The dirt on the first page after re-starting of printing is conspicuous. This phenomenon is caused by movement of contaminant 7*c* onto the paper 10. Further, $\Delta$ designates the value of $\Delta Y$ when the electrostatic recording apparatus is urgently stopped and printing is started again after cleaning of the paper carrying roll 11 is effected. Dirt is not generated on the first page. That is, the surface of the paper carrying roll 11 is cleaned by the foregoing system to thereby make it possible to remove the contaminant 7*c*. Further, a motor 18 for driving the cleaning brush 15 may be the same as the motor 19 for driving the paper carrying roll 11, and it does not matter that the rotating direction of the paper carrying roll 11 in the independent driving mode is in the forward or backward direction with respect to the paper carrying direction.

Figure 7:
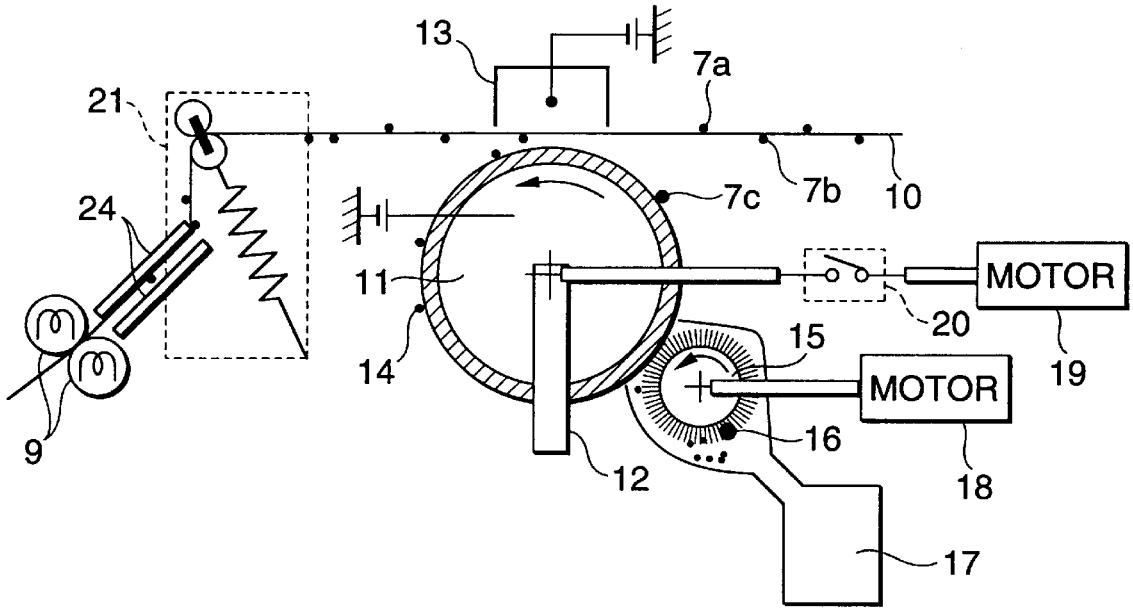
FIG. 7 is a schematic view showing the paper carrying device in the case of using pre-heat devices.
Figure 8:
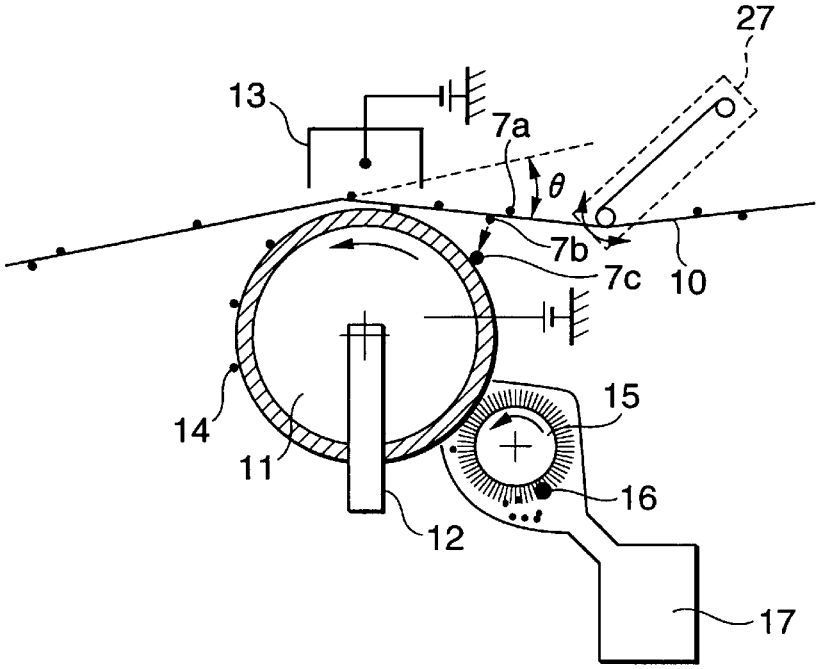
FIG. 8 is a schematic view showing another embodiment of the paper carrying device according to the present invention.
Figure 9:
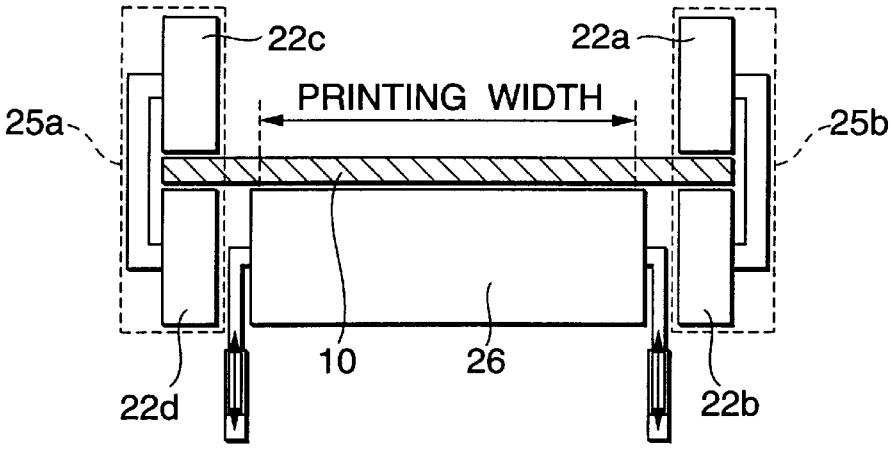
FIG. 9 is a schematic view showing the configuration of the paper carrying roll according to the present invention.
Figure 10:
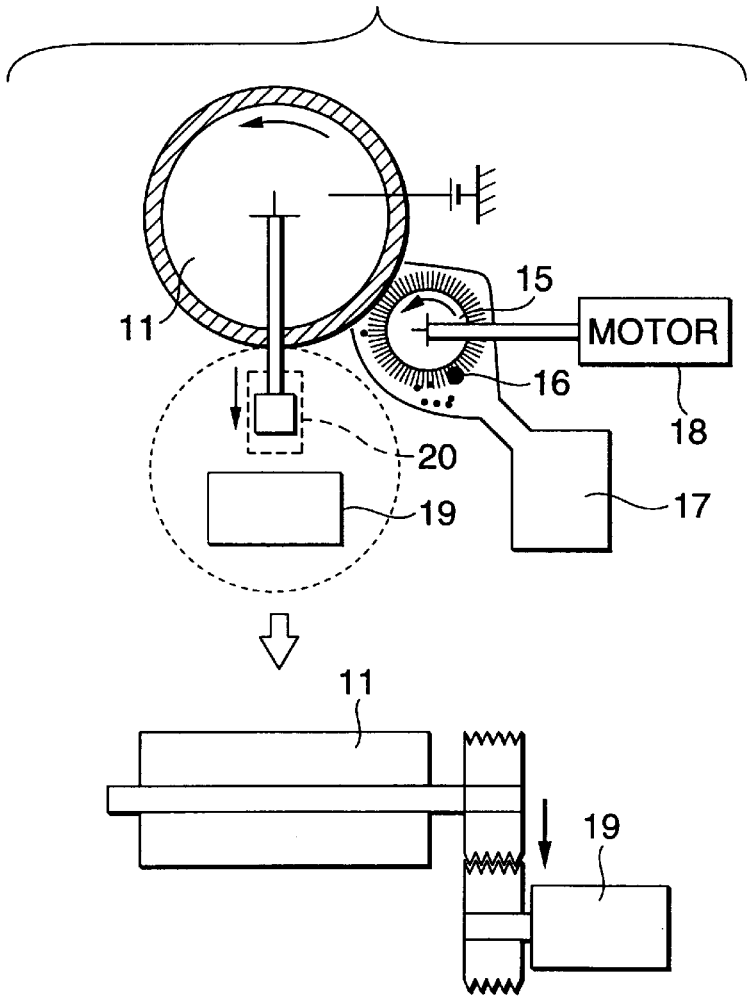
FIG. 10 shows an embodiment of the means for independently driving the paper carrying roll according to the present invention.
Figure 11:
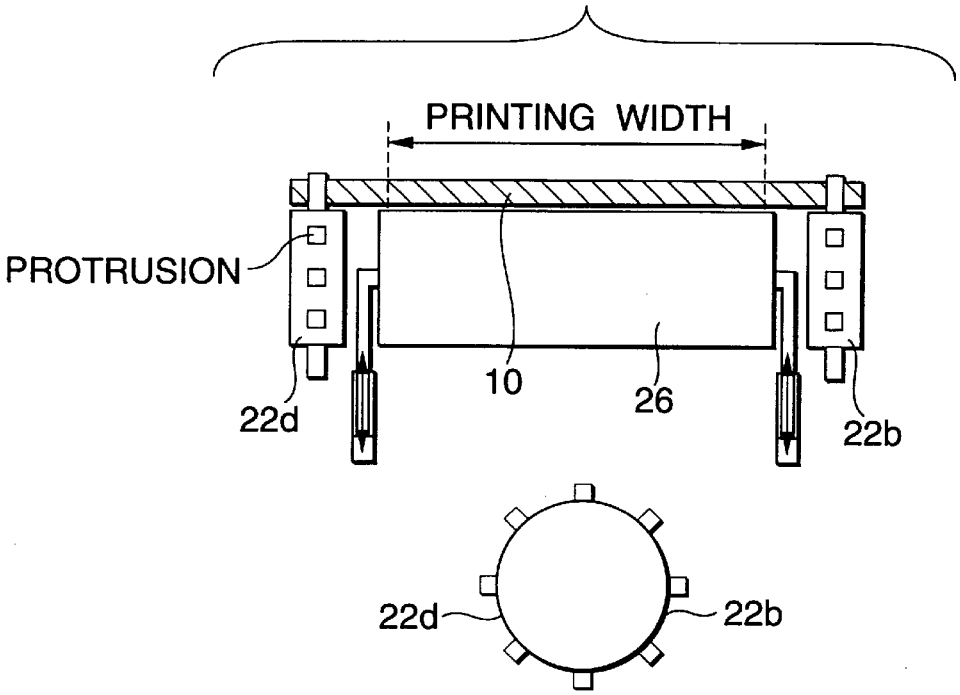
FIG. 11 is a schematic view showing the configuration of the paper carrying roll according to the present invention.

It becomes difficult to fix the toner only by means of heat rolls 9 as the printing speed is increased. In the case where pre-heat devices 24 for heating unfixed toner in advance to assist the heat rolls 9 are provided on the upstream immediately before the heat rolls 9, the paper 10 comes into contact with the pre-heat devices when the paper is separated from the roll 11 as shown in FIG. 7. As a result, disturbance is generated in the toner image at the contact portion. As a countermeasure, a buffer mechanism 27 for applying tension to the paper 10 is provided on the upstream of the paper carrying roll 11 as shown in FIG. 8. In this case, the paper is required to be lifted by the angle not smaller than θ in order to keep the paper 10 in a state of non-contact with the paper carrying roll 11. Although it is not difficult to carry out this method if the angle θ is fine, the angle θ cannot be considered to be a small value because the paper carrying roll 11 is provided for changing the carrying direction of the paper 10. Therefore, the paper 10 almost cannot be lifted so as to be in a state of non-contact with the paper carrying roll 11. On the other hand, if θ is so fine that the paper 10 can be lifted, it is not necessary to provide the paper carrying roll 11. Consequently, the paper carrying roll 11 is required to be moved so as to separate from the paper 10. FIG. 9 shows the configuration of the paper carrying roll 11 as a part of the paper carrying device 8 in this case. As shown in FIG. 9, the paper carrying roll 11 in this case is constituted by three portions, that is, opposite end portions 25*a* and 25*b* which never come into contact with images and a central portion 26 which comes into contact with the images. The opposite end portions 25*b* and 25*a* are constituted respectively by a pair of rolls 22*a* and 22*b*, and a pair of rolls 22*c* and 22*d* which follow paper 10 and which sandwich the paper 10 from above and below. Shafts supporting the rolls 22*a*–22*d* are fixed. Further, when paper-carrying sprocket holes are formed on the opposite sides of the paper 10, a roll having protrusions as shown in FIG. 11 may be used. In this case, the paper 10 may be supported from the lower side thereof. The central portion 26 corresponds to the paper carrying roll 11, and the length of the central portion 26 is longer than printing width and shorter than paper width. Moreover, the rotary shaft of the paper carrying roll 11 may be up/down moved so that a roll surface of the central portion 26 can be separated from the paper 10. As shown in FIG. 10, the rotary shaft of the paper carrying roll 11 is brought down so as to be connected to an independent driving motor 19, and the paper carrying roll 11 is made to rotate so as to clean its surface by means of a cleaning brush 15. The connection between the paper carrying roll 11 and the independent driving motor 19 may be performed by means of an electromagnetic clutch motor in place of the connection between gears as shown in FIG. 10. Further, even if the rotary shaft of the cleaning brush 15 is fixed, the quantity of lowering of the rotary shaft of the paper carrying roll 11 is selected to be about 5 mm so that the cleaning brush 15 can be used in common with the case of normal printing. In this case, the same effects as that in the case of FIG. 6 could be obtained.

Figure 12:
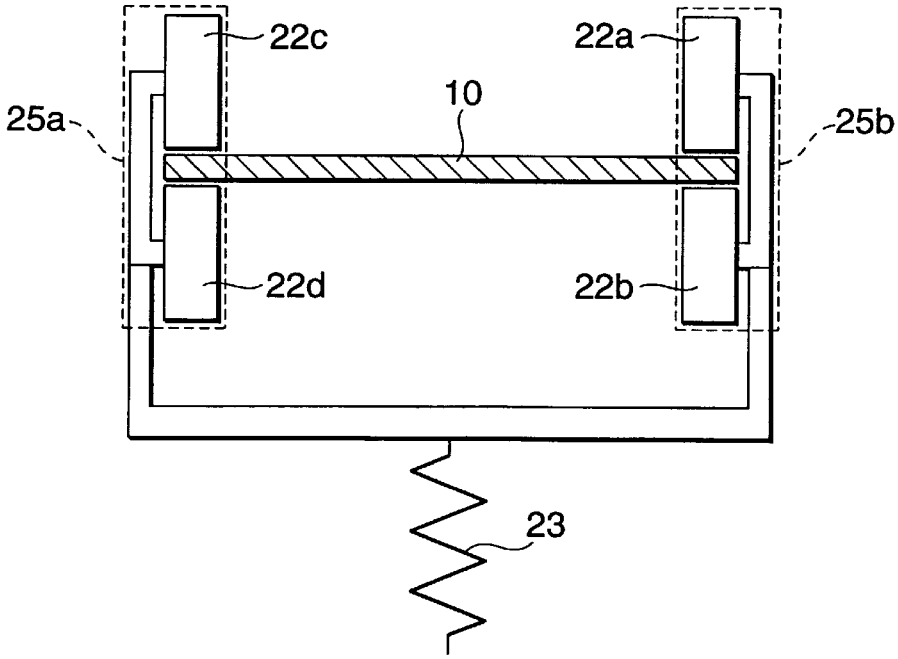
FIG. 12 is a schematic view showing the paper separating device according to the present invention.
Figure 13:
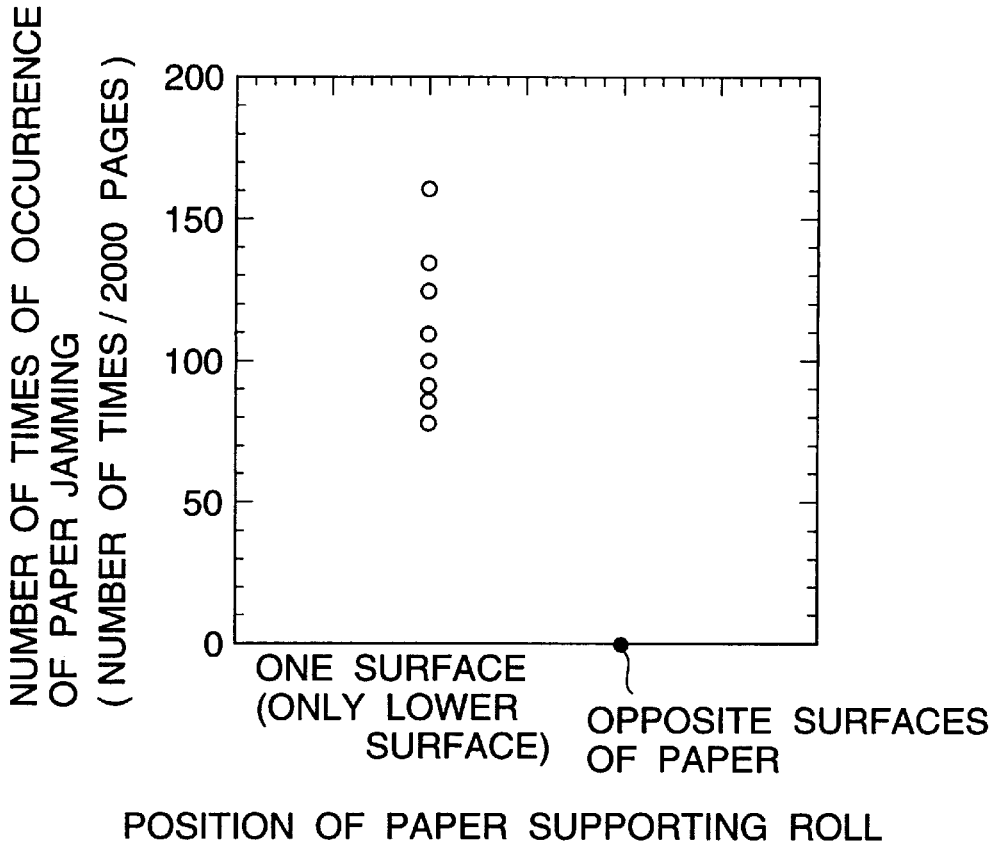
FIG. 13 is a graph showing effects of the paper separating device according to the present invention.

FIG. 12 is a diagram of the paper separating device shown in FIG. 1, viewed from the downstream side. The paper separating device 21 is configured such that only the opposite ends of paper are sandwiched at the opposite surfaces of the paper by means of paper supporting rolls 22 following the paper. Further, the respective rotary shafts of rolls 22*a* and 22*b*, 22*c* and 22*d* located at the opposite surfaces of the paper are connected to each other so that the paper is sandwiched with fixed pressure. That is, the opposite end portions 25*a* and 25*b* of the paper carrying roll 11 of the type shown in FIG. 9 are used as they are, and the shafts supporting the opposite end portions 25*a* and 25*b* are exchanged from those of the fixed type to those movable so as to act as a buffer mechanism and so as to be utilized for paper separation. An elastic member 23 is a buffer for absorbing vibrations of rolls 22*a* to 22*d* due to an outer force. For instance, the outer force is generated because a sheet 10 is flipped during the sheet transportation. The pressure to be applied to the paper from the rolls 22*a* and 22*b*, 22*c* and 22*d* varies in accordance with the kind of paper, that is, the thickness of paper, the roughness of paper surface, or the like so that the central portion of paper is prevented from being sagged because of shortage of the pressure. The sag of the paper causes meander of the paper, resulting in paper jamming. Continuous blank paper of fine quality having a weight of 55 Kg and a width of 18 inches was subjected to blank printing by 2000 pages and the number of times of generation of jamming was measured. As the measurement result, the number of times of generation of jamming caused by the paper carrying portion was approximated to zero (FIG. 13) by supporting the paper at the opposite surfaces, in comparison with the case of supporting the paper at the lower surface (only by using the rolls 22*b* and 22*d*).

Figure 14:
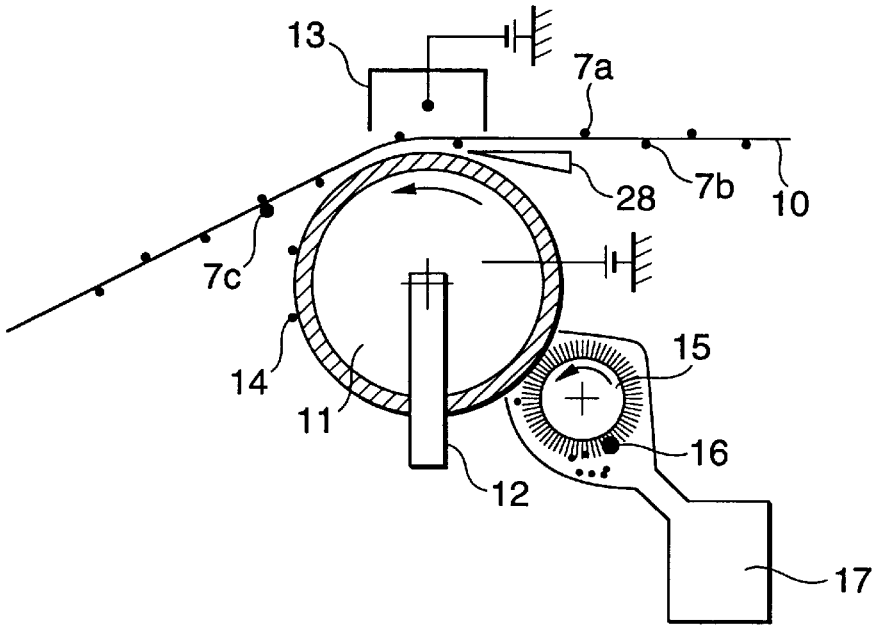
FIG. 14 is a schematic view showing a toner-falling preventing plate in the paper carrying device according to the present invention.

In order to prevent toner 7*b* from falling from the surface of the paper 10 to the surface of the paper carrying roll 11 to the utmost, a toner-falling preventing plate 28 was provided in a gap between the paper carrying roll 11 and the paper 10 located immediately before the paper carrying roll 11 (FIG. 14). As a result, the toner 7*b* falling from the paper 10 onto the surface of the paper carrying roll 11 could be received by means of the toner-falling preventing plate 28 to thereby improve the picture quality. In the case where the toner-falling preventing plate is formed of a metal material, it is preferable that the surface of the toner-falling preventing plate 28 is covered with insulating resin so as to prevent a bias voltage from leaking from the paper carrying roll 11 to the plate 28. Further, a voltage may be applied to the toner-falling preventing plate 28.

As described above, by using the paper carrying device according to the present invention, a paper carrying roll can be cleaned to thereby make it possible to stably provide a high picture quality for a long time.

What is claimed is:

1. A paper carrying device of an electrostatic recording apparatus, said device comprising:

a paper carrying roll and a cleaning mechanism; and a rotating system for the paper carrying roll, which is changed over between a following system and an independently-driving system with respect to paper, wherein said paper carrying roll is disposed between a transfer portion for forming unfixed toner particle images on the opposite surfaces of the paper and a fixing device for fixing the toner particle images.

2. A paper carrying device according to claim 1, wherein the rotating system of said paper carrying roll is changed over into the following system and the independently-driving system at the time of printing and at the time of non-printing respectively, and that at the time of non-printing, said paper carrying roll is driven in a state where paper is separated from said paper carrying roll so as to be cleaned by using said cleaning mechanism.

3. A paper carrying device according to claim 1, further comprising a paper separating device for separating paper from said paper carrying roll while a distance between said paper carrying roll and said cleaning mechanism remains fixed, and wherein said paper separating device is provided on at least one of upstream and downstream sides of said paper carrying roll.

4. A paper carrying device of an electrostatic recording apparatus provided between a transfer portion for forming unfixed toner particle images on the opposite surfaces of paper and fixing device for fixing on the opposite surfaces at the same time, said device comprising:

a paper carrying roll and a cleaning mechanism;

a rotating system for the paper carrying roll, which is changed over between a following system and an independently-driving system with respect to paper; and a paper separating means constituted by two pairs of rolls following paper provided on opposite end portions of the paper so that said two pairs of rolls sandwich the paper from front and rear surfaces thereof at non-printing areas in the vicinity of the opposite end portions of the paper to separate the paper from said paper carrying roll by vertical movement of said two pairs of rolls.

5. A paper carrying device of an electrostatic recording apparatus provided between a transfer portion for forming unfixed toner particle images on the opposite surfaces of paper and fixing device for fixing on the opposite surfaces at the same time, said device comprising:

a paper carrying roll and a cleaning mechanism; and a rotating system for the paper carrying roll, which is changed over between a following system and an independently-driving system with respect to paper, wherein said paper carrying roll is designed so as to have a longitudinal length set to be longer than printable width and shorter than paper width; and wherein rolls are provided on opposite sides of said paper carrying roll respectively, at non-printing areas of paper so as to follow the paper to thereby separate said paper carrying roll from the paper at the time of cleaning.

6. A paper carrying device of an electrostatic recording apparatus provided between a transfer portion for forming unfixed toner particle images on the opposite surfaces of paper and fixing device for fixing on the opposite surfaces at the same time, said device comprising:

a paper carrying roll and a cleaning mechanism; and a rotating system for the paper carrying roll, which is changed over between a following system and an independently-driving system with respect to paper, a toner-falling preventing plate for preventing toner from falling from paper to said paper carrying roll provided on an upstream side of said paper carrying roll.

* * * * *